US005320710A

United States Patent [19]

Reeves et al.

[11] Patent Number: 5,320,710

[45] Date of Patent: Jun. 14, 1994

[54] SOFT HIGH STRENGTH TISSUE USING LONG-LOW COARSENESS HESPERALOE FIBERS

[75] Inventors: R. Heath Reeves, Appleton; Janet D. Plantikow, Kaukauna; Laura J. Smith, Appleton; T. Philips Oriaran, Appleton; Anthony O. Awofeso, Appleton; Gary L. Worry, Appleton, all of Wis.

[73] Assignee: James River Corporation of Virginia, Richmond, Va.

[21] Appl. No.: 135,958

[22] Filed: Oct. 13, 1993

Related U.S. Application Data

[63] Continuation of Ser. No. 18,771, Feb. 17, 1993, abandoned.

[51] Int. Cl.[5] ..... D21H 11/12

[52] U.S. Cl. ..... 162/111; 162/91; 162/99; 162/148; 162/149

[58] Field of Search ..... 162/91, 99, 148, 149, 162/111

[56] References Cited

U.S. PATENT DOCUMENTS

| | | | |
|---|---|---|---|
| 154,304 | 8/1874 | Walker | 162/99 |
| 310,753 | 1/1885 | Walker | 162/99 |
| 336,376 | 2/1886 | Belk | 162/99 |
| 3,620,911 | 11/1971 | Eklund et al. | 162/91 |
| 5,059,282 | 10/1991 | Ampulski et al. | 162/111 |
| 5,102,501 | 4/1992 | Eber et al. | 162/111 |

FOREIGN PATENT DOCUMENTS

| | | | |
|---|---|---|---|
| 6429 | of 1883 | United Kingdom | 162/99 |

OTHER PUBLICATIONS

Nelson et al, "A Search for New Crops: Analytical Evaluations", *TAPPI*, vol. 49, No. 1 (Jan. 1966) pp. 40–48.

*Primary Examiner*—Peter Chin

[57] ABSTRACT

A paper product having increased thickness, absorbency, and softness without altering product strength wherein a fiber blend is provided being up to 50% softwood fibers and up to 100% Hesperaloe funifera fibers.

10 Claims, 3 Drawing Sheets

SOFT HIGH STRENGTH TISSUE USING LONG-LOW COARSENESS HESPERALOE FIBERS

This is a continuation of copending application Ser. No. 08/018,771 filed on Feb. 17, 1993, now abandoned.

BACKGROUND OF THE INVENTION

1. Field of the Invention

The present invention relates to creped sanitary tissues which are extremely soft, absorbent and drapeable making them especially suitable for such products as bathroom tissue, facial tissue and napkins.

2. Description of Background Art

In the manufacture of sanitary tissue, a significant challenge to the papermaker is to make tissues which are not only soft, absorbent and thick but also strong. Typically, softness, absorbency, and thickness are inversely related to strength. Several avenues are available to the papermaker for improving product quality. For example, to improve sheet absorbency and thickness, one can use a thru air dried process as disclosed in U.S. Pat. No. 3,301,746 by Sanford and Sisson or one can incorporate bulking fibers into the web as disclosed in U.S. Pat. No. 3,434,918 by Bernardin, U.S. Pat. No. 4,204,504 by Lesas et al., U.S. Pat. No. 4,431,481 by Drach et al., U.S. Pat. No. 3,819,470 by Shaw et al., and U.S. Pat. No. 5,087,324 by Awofeso et al. Bulking fibers can take the form of mechanical pulp or other thermally/chemically cross-linked fiber. Thicker more absorbent structures can be made using a low batting papermaking felt as described in U.S. Pat. No. 4,533,457 by Curran et al.

To improve tissue softness, several approaches are available to the papermaker such as using certain species of hardwood like eucalyptus in stratified webs as discussed in U.S. Pat. No. 4,300,981 by Carstens and U.S. Pat. No. 3,994,771 by Morgan et al. U.S. Pat. No. 3,821,068 by Shaw discloses a technique for producing a soft tissue structure by avoiding mechanical compression until the sheet has been dried to at least 80% solids. U.S. Pat. No. 3,812,000 by Salvucci et al. discloses a technique for producing a soft tissue structure by avoiding mechanical compression of an elastomer containing fiber furnish until the consistency of the web is at least 80% solids. U.S. Pat. No. 3,301,746 by Sanford and Sisson discloses a thru air dried papermaking technology for producing soft tissue structures. U.S. Pat. No. 5,164,045 by Awofeso et al. discloses a technique for making a soft tissue product by combining foam forming, stratification, and bulking fibers. Finally, U.S. Pat. No. 4,063,995 by Grossman discloses advanced creping technologies for improving the softness of tissue products.

Numerous references suggest the broad use of a myriad of alternative fibers for making generic "paper". High strength specialty papers have been made using non-woody fibers (usually termed "hard" or "cordage" fibers) such as sisal, abaca, hemp, flax and kenaf. As described in McLaughlin and Schuck, Econ. Bot 45 (4), pp 480–486, 1991; such fibers are commonly used for such products as currency paper, bank notes, tea bags, rope paper, filters, air cleaners and other products requiring "scruff" and tear resistance along with high endurance for folding. McLaughlin and Schuck suggested that such specialty products can also be formed from fibers derived from the genera Hesperaloe and Yucca in the family Agavaceae and that "their long, narrow fibers may be superior to other species currently used for pulping." Surprisingly, in light of the literature described and discussed above suggesting that these hard or cordage fibers be used for specialty papers requiring high strength and scruff resistance, we have found that chemically pulped fibers derived from the leaves of the genus Hesperaloe in the family Agavaceae are especially suitable for making extremely high quality creped tissue paper having outstanding softness and drapeability coupled with extremely high strength. McLaughlin and Schuck report neither fiber coarseness for the fibers under considerations nor the strength of papers made from these fibers making predictions about suitability for tissue-making at least very problematic, if not impossible. Accordingly, the present invention is directed to a creped tissue paper product having extremely high strength along with outstanding bulk, absorbency and softness wherein at least about 20% by weight of the fiber is derived by chemical pulping from leaves of the genus Hesperaloe, preferably *Hesperaloe funifera*. Preferably, the sanitary tissue paper product may consist essentially of at least about 40% *Hesperaloe funifera* fibers, the remainder being a fiber blend chosen from the group consisting of softwoods, hardwoods, anfractuous (bulking) fibers and recycled fiber.

SUMMARY AND OBJECTS OF THE PRESENT INVENTION

The present invention provides for the use of long low coarseness fibers derived from the leaves of the genus Hesperaloe, preferably *Hesperaloe funifera* for use in creped tissue products to obtain extremely high product strength without unduly sacrificing bulk, absorbency and softness.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
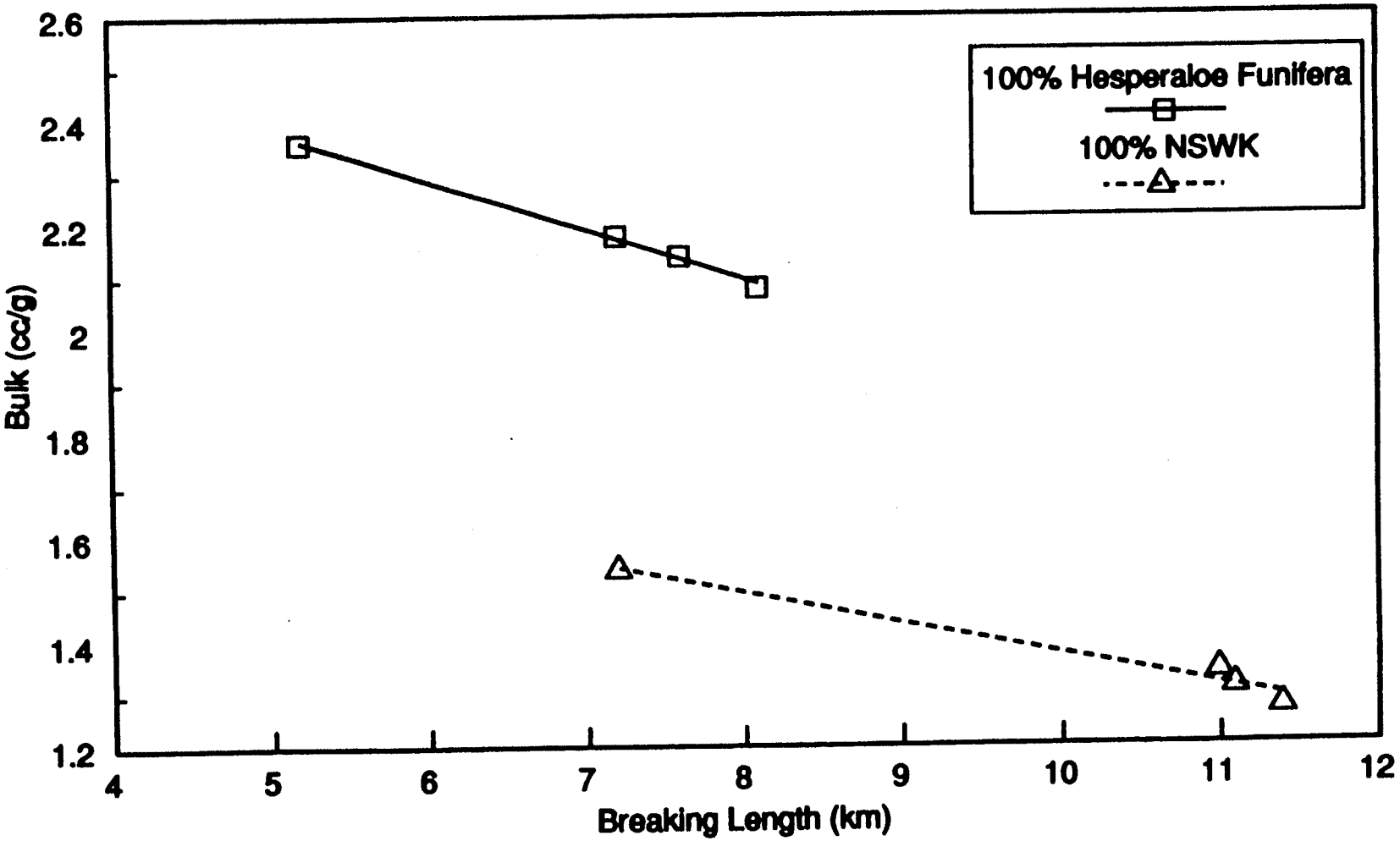
FIG. 1 is a graph illustrating the relationship between bulk and breaking length for *Hesperaloe funifera* and northern softwood kraft handsheets.

Tissue production is a relatively mature industry in the United States. Extremely large expensive paper machines are used to produce tissue from various wood pulps at very high speeds and in tremendous quantities. Even though large sums of money are expended in research directed to improving tissue products, advances are typically relatively subtle. In contrast to the often subtle distinctions between tissues made from wood pulps, we have found that it is possible to dramatically increase the quality of tissue made on existing machinery by replacing at least about 20% by weight of the furnish with chemically pulped fibers derived from the leaves of plants in the genus Hesperaloe in the family Agavaceae. Plants in the genus Hesperaloe, such as *Hesperaloe funifera,* are non-woody plants from the family Agavaceae (as are yucca and sisal) which yield long, fine fibers of low coarseness (i.e. weight per unit length). These fibers were identified as being especially suitable for tissue making in a study of the Agavaceae family where a number of species of the genera Agave, Dasylirion, Furcraea, Hesperaloe, Nolina, and Yucca were screened for suitability for use in tissuemaking. In this study, plants in the genus Hesperaloe from the family Agavaceae were found to be especially desirable for use in tissuemaking as tissues incorporating these fibers proved to provide an unexpected combination of high strength coupled with softness, bulk and absorbency properties not typically encountered in tissues having that degree of strength. When fibers such as *Hesperaloe funifera* are used in sanitary tissue products such as bathroom, facial and related tissue products, attributes such as strength, absorbency and softness are improved unexpectedly. Other examples of Hesperaloe species and hybrids are known and these have been found to show promise of good suitability for tissuemaking. Hereinafter, when we refer to the genus "Hesperaloe" in the family Agavaceae, the term should be understood to include not only *Hesperaloe funifera* but also the species *H. nocturna, H. parviflova, H. changii,* H. sp. nova (Alamos), various hybrids, and the numerous varieties as if all were individually named.

Table I shows typical fiber properties of NSWK (northern softwood kraft), SSWK (southern softwood kraft), WCSW (west coast softwood kraft), NHWK (northern hardwood kraft), eucalyptus kraft, and several non-woody fibers including samples of fiber from the genus Hesperaloe. These data show that the fibers from the genus Hesperaloe have coarseness values comparable to eucalyptus and NHWK with fiber length values greater than NSWK.

TABLE I

Fiber Properties of Typical Furnishes

| Fiber Type | Coarseness mg/100 m | Fiber Length mm |
|---|---|---|
| NSWK | 14.2 | 2.92 |
| SSWK | 26.7 | 3.46 |
| WCSW | 23.2 | 3.38 |

TABLE I-continued

Fiber Properties of Typical Furnishes

| Fiber Type | Coarseness mg/100 m | Fiber Length mm |
|---|---|---|
| NHWK | 11.0 | 1.02 |
| Eucalyptus | 7.6 | 0.99 |
| M. textilis* | 17.4 | 3.65 |
| C. sativa* | 13.8 | 3.36 |
| A. sisalana* | 14.0 | 2.45 |
| Y. elata* | 6.7 | 1.89 |
| H. changii* | 9.0 | 4.58 |
| H. funifera* | 8.0 | 2.96 |

*Non-woody plant fibers

Fibers suitable for the practice of the present invention can be prepared from the leaves of the Hesperaloe by conventional chemically based pulping methods including traditional chemical processes such as the sulfite and kraft processes, as well as semi-chemical means such as neutral sulfite and by chemi-mechanical or chemi-thermo-mechanical pulping procedures. Accordingly, pulp produced by any of the foregoing processes should be understood to be comprehended within the term "chemically pulped fibers".

Several experiments were performed showing the utility of the *Hesperaloe funifera* in sanitary tissue products. The first experiment was a handsheet study comparing a 100% chemically pulped *Hesperaloe funifera* handsheet to a 100% NSWK handsheet, both being formed according to TAPPI standards. As illustrated in FIG. 1, at the same breaking length (7.2 km), *Hesperaloe funifera* sheets have a bulk of 2.18 cc/g while the NSWK handsheets have a bulk of only 1.54 cc/g. It appears that the *Hesperaloe funifera* fiber causes a bulking effect in the handsheet structure.

Figure 2:
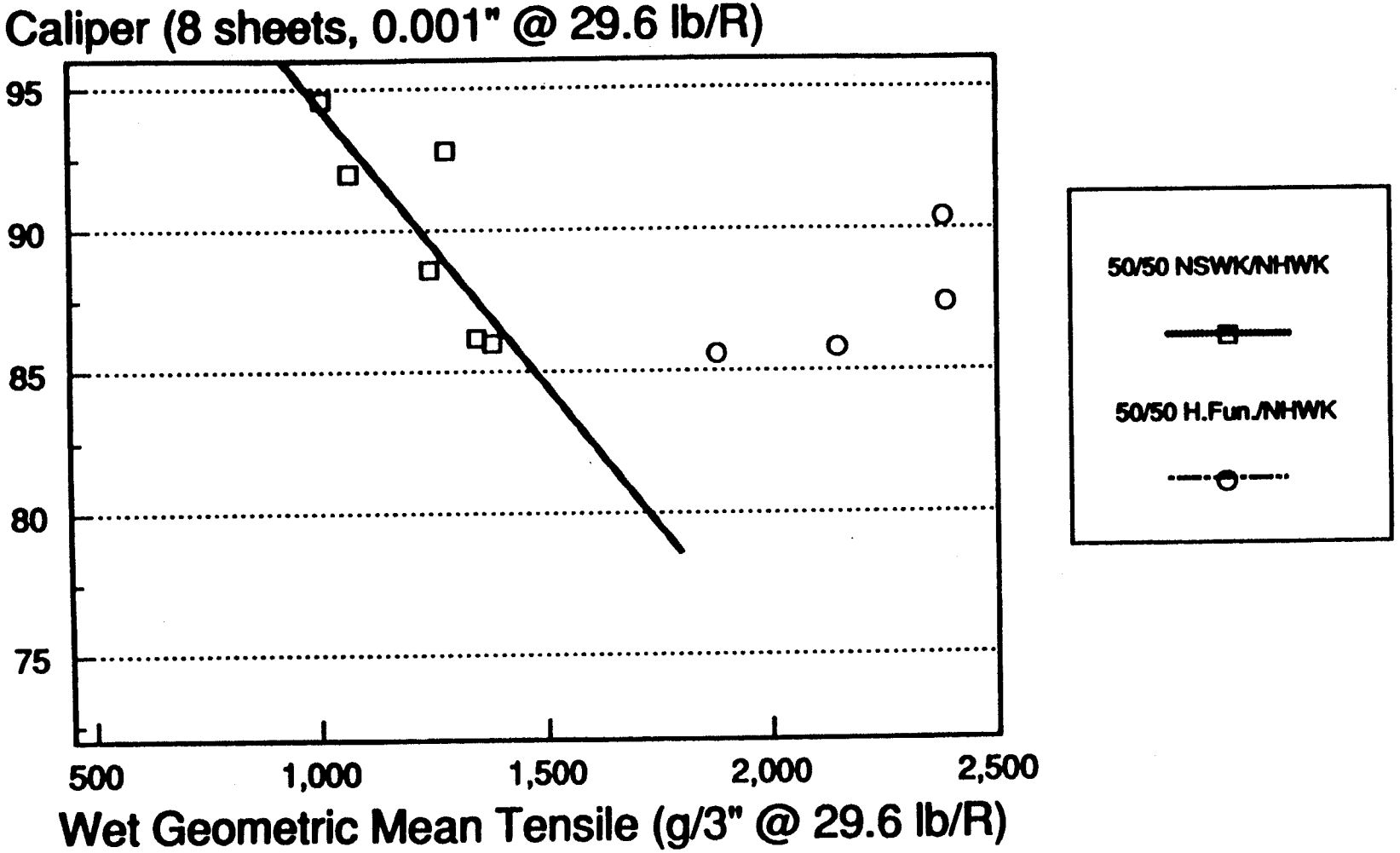
FIG. 2 is a graph illustrating the relationship between *Hesperaloe funifera* fiber in webs intended for applications requiring wet strength wherein caliper is plotted against wet geometric mean tensile for a 50% northern softwood kraft and a 50% northern hardwood kraft web as compared to a 50% *Hesperaloe funifera* and a 50% northern hardwood kraft web.
Figure 3:
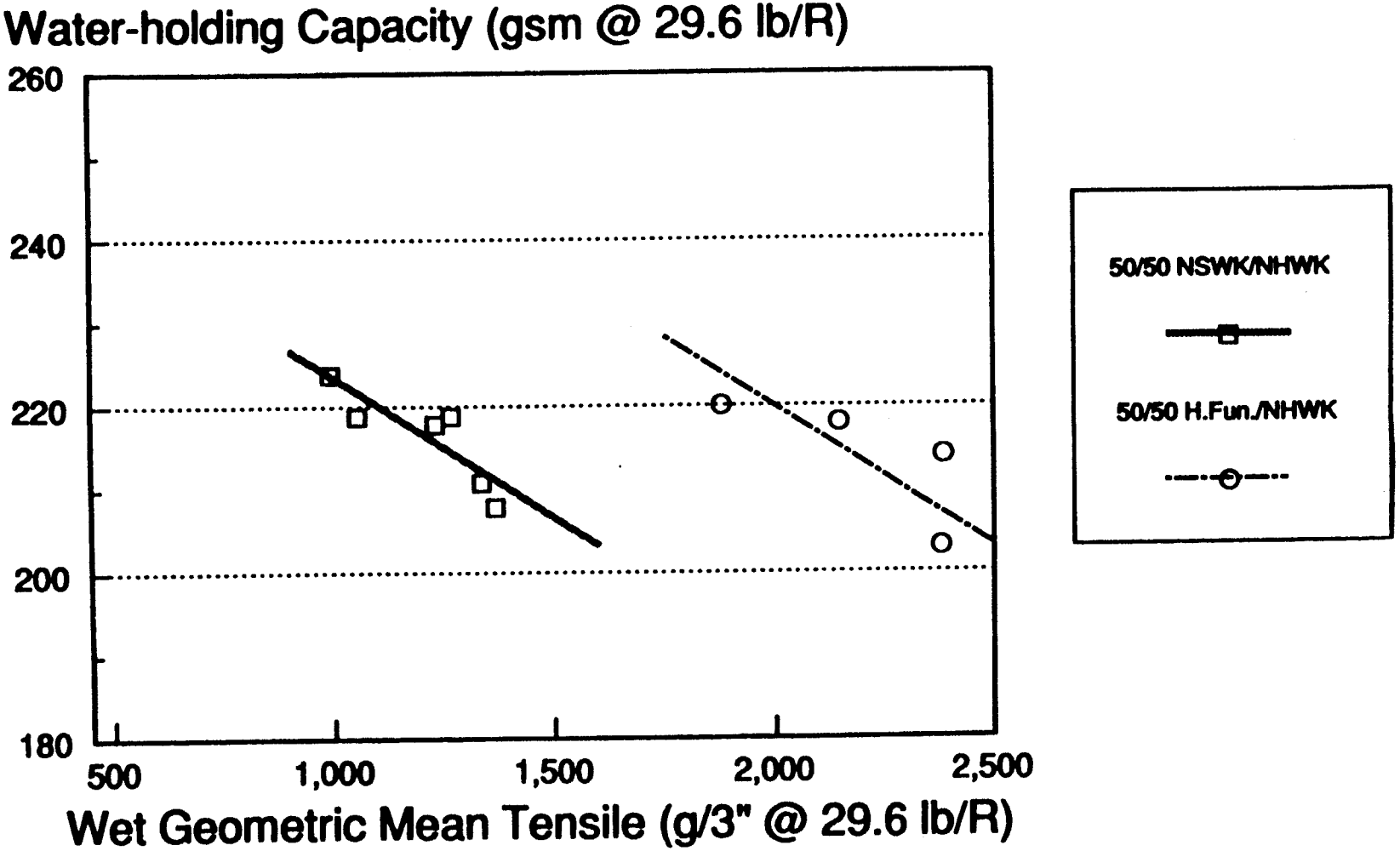
FIG. 3 is a graph illustrating *Hesperaloe funifera* fiber in web structures intended for applications requiring both wet strength and absorbency wherein water-holding capacity is plotted versus wet geometric mean tensile strength for a 50% northern softwood kraft and a 50% northern hardwood kraft web as compared to a 50% *Hesperaloe funifera* and a 50% northern hardwood kraft web.

Several trials were executed on a papermachine using a 50/50 blend of NSWK/NHWK, and a 50/50 blend of chemically pulped *Hesperaloe funifera*/NHWK. FIG. 2 shows the relationship between caliper and wet geometric mean tensile strength for two-ply 29.6 lb/3000 sq ft ream structures made from the two furnish blends while FIG. 3 shows the relationship between water holding capacity and wet geometric mean tensile strength. Both FIGS. 2 and 3 illustrate that the *Hesperaloe funifera* containing web possesses outstanding wet strength coupled with high absorbency, the Hesperaloe fiber providing a bulking effect versus a control furnish.

Homogeneously formed tissue samples having the composition: chemically pulped *H. funifera* 50%; and NHWK 50% were prepared on a papermachine, creped then compared to tissue containing 50% NSWK fibers and 50% NHWK fibers and also samples of commercially produced tissue. Specifically, the tissue samples were evaluated for basis weight, caliper, tensile strength properties, stiffness modulus, and mean deviation in the coefficient of friction. As set forth in Table II, it can be seen that the tissues incorporating chemically pulped *H. funifera* were both extremely strong and extremely flexible as evidenced by the excellent tensile strength values and the very low ratio of dry geometric mean tensile strength to geometric mean stiffness modulus.

TABLE II

| Sample Identification | Basis Wt. (lbs/rm) | Caliper (mils) | Dry GMT (gm/3") | GM Dry Stiffness Modulus (gm/% str) | Friction Deviation | Dry GMT GM Dry Stiffness Modulus |
|---|---|---|---|---|---|---|
| | Properties of Tissue Samples | | | | | |
| 50% H. Funifera/ 50% NHWK Tissue | 19.1 | 61.0 | 1837 | 27.5 | 0.193 | 67 |
| 50% NSWK/ 50% NHWK Tissue | 18.1 | 72.2 | 630 | 16.7 | 0.145 | 38 |
| Northern ® Bathroom Tissue | 19.1 | 68.7 | 603 | 22.3 | 0.165 | 27 |
| Northern ® Bathroom Tissue | 18.4 | 65.3 | 725 | 21.4 | 0.163 | 34 |
| Kleenex ® Bathroom Tissue | 17.3 | 63.5 | 586 | 17.7 | 0.185 | 33 |
| White Cloud ® Bathroom Tissue | 21.1 | 91.0 | 547 | 20.3 | 0.122 | 30 |
| Charmin ® Free Bathroom Tissue | 17.9 | 76.5 | 598 | 17.8 | 0.172 | 34 |

Accordingly, it can be seen that tissues of the present invention are exceedingly strong for a given stiffness, exhibiting a ratio of dry geometric mean tensile strength (in g per 3") to geometric mean stiffness modulus (in g per % strain measured at a load of 50 g for a one inch strip) above about 40, preferably above about 50 and more preferable above about 65.

With such pronounced softness advantages over tissues formed from premium furnishes like northern softwood, it is evident that furnishes comprising non-woody fibers like *Hesperaloe funifera* are unexpectedly desirable for creating tissue with dramatically improved quality advantages. Our studies indicate that other more recently studied non-woody fibers in the genus Hesperaloe, Hesperaloe changii and Hesperaloe sp. nova (Alamos) offer similar, potentially more desirable, benefits in tissuemaking as they have coarseness values of about 9.0 mg/100 m combined with average fiber lengths in the range of 3.5 to 4.6 mm.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A creped tissue product comprising at least about 20% by weight of chemically pulped fibers derived from the leaves of non-woody plants of the genus Hesperaloe in the family Agavaceae, said tissue having a basis weight of from about 8 to about 30 pounds per 3000 square foot ream.

2. The tissue according to claim 1, wherein said fiber is derived from leaves of *Hesperaloe funifera.*

3. The tissue according to claim 1, wherein the Hesperaloe derived fibers comprise at least about 40% by weight of said tissue and wherein the Hesperaloe derived fibers are non-woody fibers from the leaves of plants selected from the group consisting of *H. funifera, H. nocturna, H. parviflora, H. changii,* H. sp. nova (Alamos), and hybrids thereof.

4. The tissue according to claim 1 wherein the ratio of dry geometric mean tensile strength (in g per 3") to geometric mean stiffness modulus (in g per % strain measured at a load of 50 g for a one inch strip) is above about 40.

5. The tissue according to claim 1 wherein the ratio of dry geometric mean tensile strength (in g per 3") to geometric mean stiffness modulus (in g per % strain measured at a load of 50 g for a one inch strip) is above about 50.

6. The tissue according to claim 1 wherein the ratio of dry geometric mean tensile strength (in g per 3") to geometric mean stiffness modulus (in g per % strain measured at a load of 50 g for a one inch strip) is above about 65.

7. A creped tissue product consisting essentially of: (1) from about 20 to about 80% by weight of a fiber derived from the non-woody fibers of the leaves of plants selected from the group consisting of *H. funifera, H. nocturna, H. parviflora, H. changii,* H. sp. nova (Alamos), and hybrids thereof; and (2) from about 80 to about 20% by weight of fibers chosen from the group consisting of hardwood, softwood, bagasse, straw, grass and recycled fibers; said paper product having a basis weight of from about 8 to about 30 pounds per 3000 square foot ream.

8. The tissue according to claim 7 wherein the ratio of dry geometric mean tensile strength (in g per 3") to geometric mean stiffness modulus (in g per % strain measured at a load of 50 g for a one inch strip) is above about 40.

9. The tissue according to claim 7 wherein the ratio of dry geometric mean tensile strength (in g per 3") to geometric mean stiffness modulus (in g per % strain measured at a load of 50 g for a one inch strip) is above about 50.

10. The tissue according to claim 7 wherein the ratio of dry geometric mean tensile strength (in g per 3") to geometric mean stiffness modulus (in g per % strain measured at a load of 50 g for a one inch strip) is above about 65.

* * * * *